US008764279B2

(12) United States Patent
Castro et al.

(10) Patent No.: US 8,764,279 B2
(45) Date of Patent: Jul. 1, 2014

(54) Y-CROSS MIXERS AND FLUID SYSTEMS INCLUDING THE SAME

(75) Inventors: Gustavo H. Castro, Cottage Grove, MN (US); Christopher R. Kokaisel, Woodbury, MN (US)

(73) Assignee: 3M Innovation Properties Company, St. Paul, MN (US)

( * ) Notice: Subject to any disclaimer, the term of this patent is extended or adjusted under 35 U.S.C. 154(b) by 835 days.

(21) Appl. No.: 13/054,130

(22) PCT Filed: Jul. 15, 2009

(86) PCT No.: PCT/US2009/050715

§ 371 (c)(1), (2), (4) Date: Mar. 8, 2011

(87) PCT Pub. No.: WO2010/009247

PCT Pub. Date: Jan. 21, 2010

(65) Prior Publication Data

US 2011/0176965 A1 Jul. 21, 2011

Related U.S. Application Data

(60) Provisional application No. 61/081,857, filed on Jul. 18, 2008.

(51) Int. Cl.
*B81B 1/00* (2006.01)

(52) U.S. Cl.
USPC ..... 366/341; 366/DIG. 2

(58) Field of Classification Search
CPC .... B01F 5/0601; B01F 5/0644; B01F 5/0645; B01F 5/064; B01F 13/0059; B81B 1/002
USPC ..... 366/336–341, DIG. 1, DIG. 2, DIG. 3, 366/DIG. 4
See application file for complete search history.

(56) References Cited

U.S. PATENT DOCUMENTS

| | | | | |
|---|---|---|---|---|
| 3,927,868 | A | 12/1975 | Moore | |
| 4,027,857 | A | 6/1977 | Cunningham | |
| 5,851,067 | A | 12/1998 | Fleischli | |
| 6,409,378 | B1 | 6/2002 | Kessler | |
| 6,645,432 | B1 * | 11/2003 | Anderson et al. | 422/502 |

(Continued)

FOREIGN PATENT DOCUMENTS

| | | |
|---|---|---|
| JP | 10-43564 | 2/1998 |
| JP | 2003-302359 | * 10/2003 |

(Continued)

OTHER PUBLICATIONS

International Search Report PCT/US2009/050715; Feb. 24, 2010, 3 pgs.

(Continued)

*Primary Examiner* — Charles E Cooley
(74) *Attorney, Agent, or Firm* — Yufeng Dong; Nancy M. Lambert

(57) ABSTRACT

Static mixers and fluid systems incorporating one or more of the static mixers. The static mixers include a mixing structure formed within a body, wherein fluid flowing through the mixing structure defines a downstream direction through the mixing structure. The mixing structure includes a series of Y-shaped channels that cross to provide flowpaths that result in efficient mixing.

22 Claims, 3 Drawing Sheets

(56) References Cited

U.S. PATENT DOCUMENTS

| | | | | |
|---|---|---|---|---|
| 6,676,835 | B2 * | 1/2004 | O'Connor et al. | 210/542 |
| 6,877,892 | B2 * | 4/2005 | Karp | 366/341 |
| 6,890,093 | B2 * | 5/2005 | Karp et al. | 366/336 |
| 6,935,772 | B2 * | 8/2005 | Karp et al. | 366/341 |
| 7,066,641 | B2 * | 6/2006 | Honda | 366/340 |
| 7,097,347 | B2 | 8/2006 | Vanden Bussche | |
| 7,753,580 | B2 * | 7/2010 | Woehl et al. | 366/178.1 |
| 8,591,841 | B2 * | 11/2013 | Asano et al. | 422/603 |
| 2001/0053108 | A1 | 12/2001 | Jahn | |
| 2002/0113009 | A1 * | 8/2002 | O'Connor et al. | 210/511 |
| 2004/0037161 | A1 * | 2/2004 | Honda et al. | 366/176.1 |
| 2004/0145967 | A1 * | 7/2004 | Honda | 366/336 |
| 2004/0218469 | A1 | 11/2004 | Unterlander | |
| 2005/0276160 | A1 * | 12/2005 | Woehl et al. | 366/336 |
| 2006/0087917 | A1 | 4/2006 | Ehrfeld | |
| 2006/0153741 | A1 * | 7/2006 | Yoshida | 422/100 |
| 2009/0114285 | A1 * | 5/2009 | Hashimoto et al. | 137/13 |
| 2011/0176965 | A1 * | 7/2011 | Castro et al. | 422/69 |

FOREIGN PATENT DOCUMENTS

| | | | | |
|---|---|---|---|---|
| JP | 2005-172521 | | 6/2005 | |
| KR | 10-0523983 | | 10/2005 | |
| WO | 2010-009233 | | 1/2010 | |
| WO | 2010-009239 | | 1/2010 | |
| WO | WO 2010009247 | A2 * | 1/2010 | B01F 5/06 |

OTHER PUBLICATIONS

Tan et al.; Development of Novel Micro Mixer and Its Application to μ-Immunomagnetic Cell Sorter; Dept. of Mechanical Engineering and Center for Disease Biology and Intergrative Medicine, the University of Tokyo, 3 pages, Undated.

Caterpillar Split-Recombine Micro Mixer, CPMM-V1.2 Group Class-R300, -R600, -R1200, -R2400; pp. 40-43, Undated.

* cited by examiner

Y-CROSS MIXERS AND FLUID SYSTEMS INCLUDING THE SAME

CROSS REFERENCE TO RELATED APPLICATIONS

This application claims the benefit of U.S. Provisional Patent Application No. 61/081,857, filed Jul. 18, 2008, which is incorporated herein by reference.

Efficient and thorough mixing of materials is a need that is addressed by many different static and dynamic mixers, although many conventional mixers used to mix small volumes of materials often rely on electrical or magnetic fields, long micro-channels or generation of alternating adjacent fluid layers with thicknesses in the micrometer (μm) range (e.g., 25-40 μm). These fluid layers are then redirected such that the fluid layers mix. In many instances, however, the mixers suffer from issues such as relatively high pressure drop, limited flow rates, inefficient mixing, etc.

SUMMARY OF THE INVENTION

The present invention provides static mixers and fluid systems incorporating one or more of the static mixers. The static mixers preferably include a mixing structure formed within a body, wherein fluid flowing through the mixing structure defines a downstream direction through the mixing structure. The mixing structure preferably includes a series of Y-shaped channels that cross to provide flowpaths that result in efficient mixing.

It may be preferred that the static mixers of the present invention be capable of mixing small microfluidic volumes of fluids. As used herein, microfluidic static mixers include channels that have a cross-sectional area (taken in a plane perpendicular to the downstream flow direction) on the order of 12,500 micrometers (μm) or less. Furthermore, it may be preferred that microfluidic static mixers be capable of mixing fluids with Reynolds numbers in the range of one (1) or less (e.g., $Re \leq 1$).

One potential advantage of the mixers of the present invention may include, e.g., a reduction in non-specific binding of analytes to the mixing structures which may be beneficial in connection with biological materials passed through the mixers. In part, the non-specific binding may be reduced by the small surface area to which the biological materials are exposed.

Another potential advantage of the mixers of the present invention is an ability to process smaller sample volumes because of a reduction in the amount of dead volume in the mixers of the present invention.

In some embodiments, static mixers of the present invention may be provided in the form of a multilayer structure that can be manufactured by assembling individual layers in which selected channels and vias are formed before the layers are assembled. Preforming the channels and vias in layers may provide a convenient and economical static mixer structure, particularly where the layers are formed by etching, sintering, etc.

In one aspect, the present invention provides a static mixer having a mixing structure formed within a body, wherein fluid flowing through the mixing structure defines a downstream direction through the mixing structure. The mixing structure further includes a first layer having a set of discrete first Y-shaped channels spaced apart along the downstream direction, wherein each first Y-shaped channel includes a base leg extending in the downstream direction to a branch point at which the main channel separates into a first arm and a second arm; and a second layer having a set of discrete second Y-shaped channels spaced apart along the downstream direction, wherein each second Y-shaped channel includes a base leg extending in the downstream direction to a branch point at which the main channel separates into a first arm and a second arm; wherein fluid flowing in the downstream direction through the first arms of the first Y-shaped channels in the first layer passes to the base legs of the second Y-shaped channels in the second layer, and wherein fluid flowing in the downstream direction through the second arms of the first Y-shaped channels passes to the base legs of successive first Y-shaped channels in the first layer; and wherein fluid flowing in the downstream direction through the first arms of the second Y-shaped channels in the second layer passes to the base legs of the first Y-shaped channels in the first layer, and wherein fluid flowing in the downstream direction through the second arms of the second Y-shaped channels passes to the base legs of successive second Y-shaped channels in the second layer.

The static mixers may also include an intermediate layer located between the first layer and the second layer, wherein the fluid flowing through the first arms of the first Y-shaped channels to the base legs of the second Y-shaped channels may pass through first cross channels located in the intermediate layer; and the fluid flowing through the second arms of the first Y-shaped channels to the base legs of the successive first Y-shaped channels may pass through second cross channels located in the intermediate layer. The first cross channel and the second cross channels may form a series of successive X-shaped channel structures spaced apart from each other along the downstream direction. The fluid flowing through the first arms of the second Y-shaped channels to the base legs of the first Y-shaped channels may pass through the second cross channels in the intermediate layer, and the fluid flowing through the second arms of the second Y-shaped channels to the base legs of the successive second Y-shaped channels may pass through the first cross channels in the intermediate layer. The first cross channel and the second cross channels may form a series of successive X-shaped channel structures spaced apart from each other along the downstream direction.

The static mixers of the present invention may also include one or more of the following features: the base leg and the first arm of each of the first Y-shaped channels may be aligned with the downstream direction and the second arm extends away to one side of the downstream direction; the base leg and the first arm of each of the second Y-shaped channels may be aligned with the downstream direction and the second arm extends away to one side of the downstream direction; the first Y-shaped channels and the second Y-shaped channels may be located opposite from each other in a Z-direction that is perpendicular to the downstream direction and the first arms of the first Y-shaped channels may be in fluid communication with the second arms of the second Y-shaped channels through Z-direction vias extending between the first layer and the second layer; the first Y-shaped channels and the second Y-shaped channels may be located opposite from each other in a Z-direction that is perpendicular to the downstream direction and the second arms of the first Y-shaped channels may be in fluid communication with the first arms of the second Y-shaped channels through Z-direction vias extending between the first layer and the second layer; the first Y-shaped channels and the second Y-shaped channels may be located opposite from each other in a Z-direction that is perpendicular to the downstream direction, and the first arms of the first Y-shaped channels are in fluid communication with the second arms of the second Y-shaped channels through Z-direction vias extending between the first layer and the second layer, and the second arms of the first Y-shaped channels are in fluid communication with the first arms of the second Y-shaped channels through Z-direction vias extending between the first layer and the second layer; the body is a flexible body; the downstream direction is a straight linear path; the downstream direction comprises a curvilinear path; etc.

In another aspect, the present invention may provide a static mixer having a mixing structure formed within a body, wherein fluid flowing through the mixing structure defines a downstream direction through the mixing structure. The mixing structure further includes a first layer having a set of discrete first Y-shaped channels spaced apart along the downstream direction, wherein each first Y-shaped channel includes a base leg extending in the downstream direction to a branch point at which the main channel separates into a first arm and a second arm; and a second layer having a set of discrete second Y-shaped channels spaced apart along the downstream direction, wherein each second Y-shaped channel includes a base leg extending in the downstream direction to a branch point at which the main channel separates into a first arm and a second arm; an intermediate layer located between the first layer and the second layer, wherein the fluid flowing through the first arms of the first Y-shaped channels to the base legs of the second Y-shaped channels passes through first cross channels located in the intermediate layer; and wherein the fluid flowing through the second arms of the first Y-shaped channels to the base legs of the successive first Y-shaped channels passes through second cross channels located in the intermediate layer; and wherein fluid flowing in the downstream direction through the first arms of the first Y-shaped channels in the first layer passes to the base legs of the second Y-shaped channels in the second layer, and wherein fluid flowing in the downstream direction through the second arms of the first Y-shaped channels passes to the base legs of successive first Y-shaped channels in the first layer; and wherein fluid flowing in the downstream direction through the first arms of the second Y-shaped channels in the second layer passes to the base legs of the first Y-shaped channels in the first layer, and wherein fluid flowing in the downstream direction through the second arms of the second Y-shaped channels passes to the base legs of successive second Y-shaped channels in the second layer; and wherein the first Y-shaped channels and the second Y-shaped channels are located opposite from each other in a Z-direction that is perpendicular to the downstream direction, and further wherein the second arms of the first Y-shaped channels are in fluid communication with the first arms of the second Y-shaped channels through Z-direction vias extending through the intermediate layer and between the first layer and the second layer.

In another aspect, the present invention may provide a fluid handling system that includes a static mixer of the present invention; a first chamber located upstream of the static mixer; and a second chamber located downstream of the static mixer, and fluid connection channels extending between the static mixer, the first chamber, and the second chamber.

The static mixers in the fluid systems of the present invention may also include an intermediate layer located between the first layer and the second layer, wherein the fluid flowing through the first arms of the first Y-shaped channels to the base legs of the second Y-shaped channels may pass through first cross channels located in the intermediate layer; and the fluid flowing through the second arms of the first Y-shaped channels to the base legs of the successive first Y-shaped channels may pass through second cross channels located in the intermediate layer. The first cross channel and the second cross channels may form a series of successive X-shaped channel structures spaced apart from each other along the downstream direction. The fluid flowing through the first arms of the second Y-shaped channels to the base legs of the first Y-shaped channels may pass through the second cross channels in the intermediate layer, and the fluid flowing through the second arms of the second Y-shaped channels to the base legs of the successive second Y-shaped channels may pass through the first cross channels in the intermediate layer. The first cross channel and the second cross channels may form a series of successive X-shaped channel structures spaced apart from each other along the downstream direction.

The static mixers in the fluid systems of the present invention may also include one or more of the following features: the base leg and the first arm of each of the first Y-shaped channels may be aligned with the downstream direction and the second arm extends away to one side of the downstream direction; the base leg and the first arm of each of the second Y-shaped channels may be aligned with the downstream direction and the second arm extends away to one side of the downstream direction; the first Y-shaped channels and the second Y-shaped channels may be located opposite from each other in a Z-direction that is perpendicular to the downstream direction and the first arms of the first Y-shaped channels may be in fluid communication with the second arms of the second Y-shaped channels through Z-direction vias extending between the first layer and the second layer; the first Y-shaped channels and the second Y-shaped channels may be located opposite from each other in a Z-direction that is perpendicular to the downstream direction and the second arms of the first Y-shaped channels may be in fluid communication with the first arms of the second Y-shaped channels through Z-direction vias extending between the first layer and the second layer; the first Y-shaped channels and the second Y-shaped channels may be located opposite from each other in a Z-direction that is perpendicular to the downstream direction, and the first arms of the first Y-shaped channels are in fluid communication with the second arms of the second Y-shaped channels through Z-direction vias extending between the first layer and the second layer, and the second arms of the first Y-shaped channels are in fluid communication with the first arms of the second Y-shaped channels through Z-direction vias extending between the first layer and the second layer; etc.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, "a," "an," "the," "at least one," and "one or more" are used interchangeably. The term "and/or" (if used) means one or all of the identified elements/features or a combination of any two or more of the identified elements/features.

The term "and/or" means one or all of the listed elements/features or a combination of any two or more of the listed elements/features.

The above summary is not intended to describe each embodiment or every implementation of the present invention. Rather, a more complete understanding of the invention will become apparent and appreciated by reference to the following Detailed Description of Exemplary Embodiments and claims in view of the accompanying figures of the drawing.

BRIEF DESCRIPTIONS OF THE VIEWS OF THE DRAWING

The present invention will be further described with reference to the views of the drawing, wherein.

DETAILED DESCRIPTION OF EXEMPLARY EMBODIMENTS OF THE INVENTION

Figure 1:
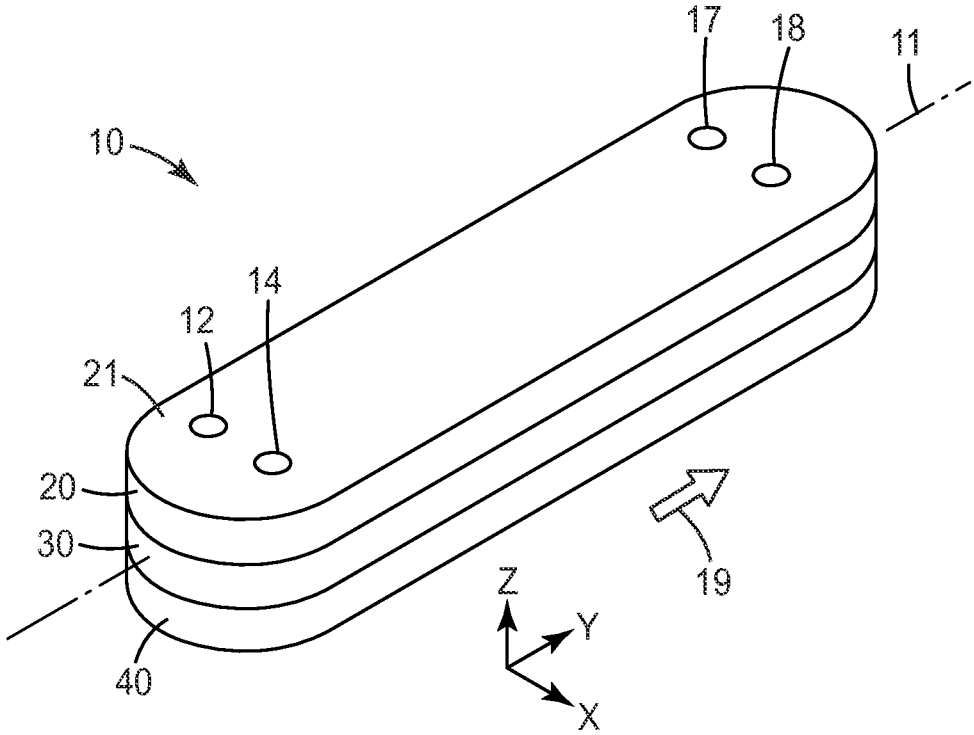
FIG. 1 is a perspective view of a body containing one example of a static mixer according to the present invention.

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

A body 10 containing one exemplary static mixer is depicted in the perspective view of FIG. 1. As depicted in FIG. 1, the body 10 is a multilayer structure including three layers, a first layer 20, an intermediate layer 30, and a second layer 40, where the intermediate layer 30 is located between the first layer 20 and the second layer 30.

The body 10 preferably includes a first inlet 12 and a second inlet 14, both of which preferably open into the static mixer located in the body 10. The static mixer in body 10 also preferably includes a first outlet 17 and a second outlet 18 through which fluids exit the static mixer formed in the body 10. Although the static mixer in body 10 includes a pair of inlets 12 & 14 and a pair of outlets 17 & 18, the static mixer may (in some embodiments) be formed to provide only a single inlet and/or a single outlet.

The inlets 12 & 14 and outlets 17 & 18 may define a downstream direction (generally aligned with the longitudinal axis 11) in which fluids passing through the static mixer move. In the view of FIG. 1, the downstream flow direction is represented by arrow 19. In other words, the fluids being mixed in the static mixer in body 10 may enter through inlets 12 & 14 and, after mixing, exit the static mixer through the outlets 17 & 18. In between the inlets 12 & 14 and the outlets 17 & 18, the fluids may preferably move in a downstream direction 19 that is generally aligned with the longitudinal axis 11 extending through the body 10.

Figure 4:
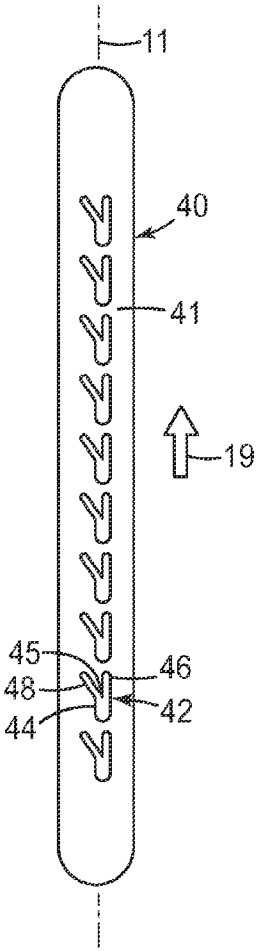
FIG. 4 is a plan view of another layer including another set of Y-shaped channels of the static mixer of FIG. 1.
Figure 3A:
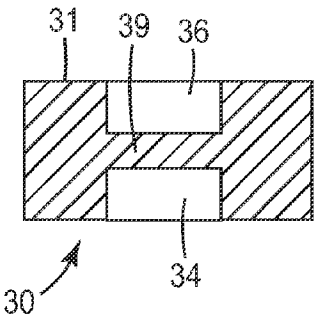
FIG. 3A is a cross-sectional view of the layer depicted in FIG. 3, with the cross-sectional view being taken along line 3A-3A in FIG. 3.
Figure 3:
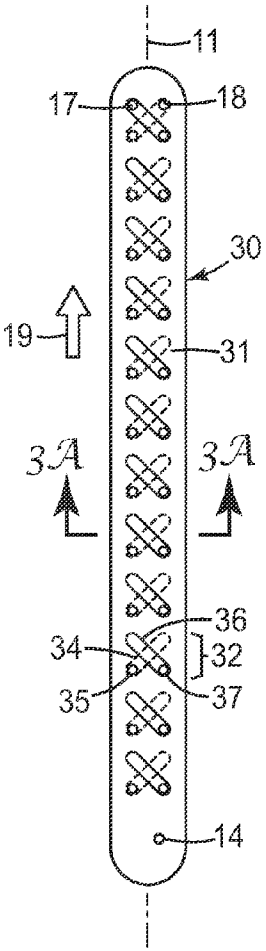
FIG. 3 is a plan view of an intermediate layer that may be located between the outer layers of the static mixer of FIG. 1.
Figure 2:
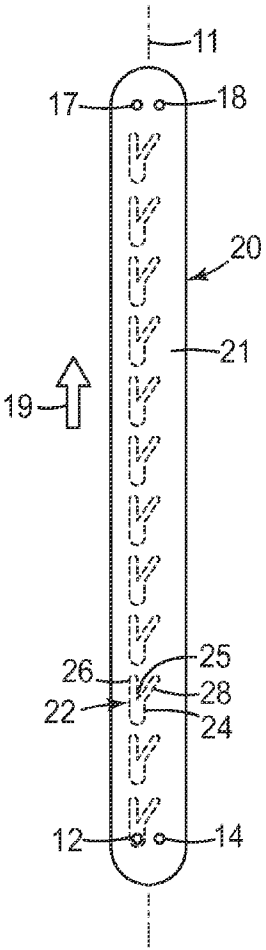
FIG. 2 is a plan view of one layer including one set of Y-shaped channels of the mixer of FIG. 1.

The layers that are combined to form the body 10 are depicted separately FIGS. 2-4, where the channels that form the static mixer in the body 10 are depicted. Each of those layers will be described below for a more complete understanding of the operation of the static mixer in body 10.

A plan view of the first layer 20 is depicted in FIG. 2. The first layer 20 includes a set of discrete Y-shaped channels 22 spaced apart along the downstream direction 19 (which is generally aligned with the longitudinal axis 11 as described in connection with FIG. 1). Although the depicted first layer 20 includes ten Y-shaped channels 22, the static mixers may be manufactured with more or less than ten Y-shaped channels 22 in the first layer 20. The number of Y-shaped channels 22 provided may be based on a variety of factors such as, e.g., the materials to be mixed, the size constraints on the body 10, etc.

The Y-shaped channels 22 formed in the depicted embodiment of first layer 20 have a depth determined between the major surfaces of the first layer 20 where only the first major surface 21 is seen in FIG. 2. In other words, the Y-shaped channels 22 do not extend through the thickness of the first layer 20. Furthermore, the Y-shaped channels 22 are formed into the major surface of the layer 20 that is not seen in FIG. 2. As a result, the Y-shaped channels 22 are not actually exposed in the view of FIG. 2 and, thus, are depicted in broken lines in FIG. 2.

Each of the each Y-shaped channels 22 depicted in FIG. 2 includes a base leg 24 extending in the downstream direction (generally aligned with the longitudinal axis 11) to a branch point 25 at which the Y-shaped channel 22 separates into a first arm 26 and a second arm 28. It may be preferred that the sum of the cross-sectional areas of the first arm 26 and the second arm 28 be equivalent to the cross-sectional area of the base leg 24 such that the flow of fluid from the base leg 24 into the first arm 26 and the second arm 28 is not restricted due to a narrowing of the overall passage size when moving from the base leg 24 to the first arm 26 and the second arm 28.

In the depicted Y-shaped channels 22, the first arm 26 extends in a direction from the branch point 25 that is generally aligned with the base leg 24 along the longitudinal axis 11. The second arm 28 extends off to one side of the longitudinal axis 11. In the depicted Y-shaped channels 22, the second arms 28 all extend to the right of the longitudinal axis 11 when viewed along the downstream direction. Although all of the Y-shaped channels 22 depicted in FIG. 2 are similarly shaped and oriented, such a n arrangement is not required. Furthermore, although the first arms 26 of the depicted Y-shaped channels 22 are generally aligned with the base legs 24 along the longitudinal axis 11, such an arrangement is not required.

The first layer 20 depicted in FIG. 2 includes the inlets 12 & 14 of the body 10, with the inlets being formed through the major surface 21 of the layer 20. The inlet 12 is formed such that it opens into the base leg 24 of the first Y-shaped channel 22. The second inlet 14 is formed through the entire thickness of the first layer 20, such that fluids directed through the second inlet 14 pass through the first layer 20 and, preferably, do not enter the Y-shaped channels 22 formed in the first layer 20.

A plan view of the intermediate layer 30 is depicted in FIG. 3. The intermediate layer 30 includes a set of successive discrete X-shaped channel structures 32 that are spaced apart from each other along the downstream direction 19 (which, as described herein, is generally aligned with the longitudinal axis 11).

Although the depicted intermediate layer 20 includes ten X-shaped channel structures 32 (corresponding to the depicted ten Y-shaped channel structures 22 in first layer 20), the static mixers may be manufactured with more or less than ten X-shaped channel structures 32. The number of X-shaped channel structures 32 may preferably be selected to correspond to the number of Y-shaped channel structures 22 in the first layer 20.

The X-shaped channel structures 32 formed in the depicted embodiment of intermediate layer 30 have a depth determined between the major surfaces of the intermediate layer 30 where only the first major surface 31 of the intermediate layer 30 is seen in FIG. 3. In other words, the X-shaped channel structures 32 may preferably not extend through the entire thickness of the intermediate layer 30.

Each of the X-shaped channel structures 32 also preferably includes a first cross channel 34 that is preferably formed into the major surface of the intermediate layer 30 that is not seen in FIG. 3. The first cross channel 34 preferably does not extend through the entire thickness of the intermediate layer 30. Because the first cross channel 34 is not seen in the plan view of FIG. 3, much of the first cross channel 34 is depicted in broken lines in FIG. 3.

The first cross-channels 34 do, however, preferably include Z-direction vias 35 at their upstream ends that do extend through the entire thickness of the intermediate layer 30 and as a result, those vias 35 are depicted in solid lines in FIG. 3. As used herein, the "Z-direction" refers to a direction that is preferably generally perpendicular to the major surfaces of the intermediate layer 30 (which would typically make the Z-direction orientation also generally perpendicular to the longitudinal axis 11). For reference purposes, FIG. 1 includes a generally x-y-z direction legend.

Each of the X-shaped channel structures 32 also preferably includes a second cross channel 36 formed into the first major surface 31 of the intermediate layer 30. Like the first cross channels 34, the second cross channels 36 preferably do not extend through the entire thickness of the intermediate layer 30.

The second cross channels 36 do, however, preferably include Z-direction vias 37 at their upstream ends that do extend through the entire thickness of the intermediate layer 30.

It may be preferred that the first cross channels 34 and the second cross channels 36 in a given X-shaped channel structure 32 are separate and distinct from each other. In other words, it may be preferred that fluids passing through the first cross channel 34 in a given X-shaped channel structure 32 do not intermix with fluids passing through the second cross-channel 36 in that X-shaped channel structure 32. This feature is depicted in connection with the cross-sectional view of FIG. 3A in which the first cross channel 34 is separated from the second cross channel 36 by a portion 39 of the intermediate layer 30.

A plan view of the second layer 40 is depicted in FIG. 4. The second layer 40 includes a set of discrete Y-shaped channels 42 spaced apart along the downstream direction 19 (which is generally aligned with the longitudinal axis 11 as described in connection with FIG. 1). It may be preferred that the second layer 40 include ten Y-shaped channels 42 to correspond to the number of Y-shaped channels 22 and X-shaped channel structures 32 in the first layer 20 and the intermediate layer 30.

The Y-shaped channels 42 formed in the depicted embodiment of second layer 40 have a depth determined between the major surfaces of the second layer 40 where only the first major surface 41 is seen in FIG. 4. In other words, the Y-shaped channels 42 do not extend through the thickness of the second layer 40.

Each of the each Y-shaped channels 42 depicted in FIG. 4 includes a base leg 44 extending in the downstream direction (generally aligned with the longitudinal axis 11) to a branch point 45 at which the Y-shaped channel 42 separates into a first arm 46 and a second arm 48. It may be preferred that the sum of the cross-sectional areas of the first arm 46 and the second arm 48 be equivalent to the cross-sectional area of the base leg 44 such that the flow of fluid from the base leg 44 into the first arm 46 and the second arm 48 is not restricted due to a narrowing of the overall passage size when moving from the base leg 44 to the first arm 46 and the second arm 48.

In the depicted Y-shaped channels 42 of FIG. 4, the first arm 46 extends in a direction from the branch point 45 that is generally aligned with the base leg 44 along the longitudinal axis 11. The second arm 48 extends off to one side of the longitudinal axis 11. In the depicted Y-shaped channels 42, the second arms 48 all extend to the left of the longitudinal axis 11 when viewed along the downstream direction. Although all of the Y-shaped channels 42 depicted in FIG. 4 are similarly shaped and oriented, such an arrangement is not required. Furthermore, although the first arms 46 of the depicted Y-shaped channels 42 are generally aligned with the base legs 44 along the longitudinal axis 11, such an arrangement is not required.

When assembled with a first layer 20, it may be preferred that the intermediate layer 30 be aligned with the first layer 20 such that the via 35 at the upstream end of the first cross channel 34 of each of the X-shaped channel structures 32 is located at the downstream end of the first arm 26. As a result, fluids passing through the first arm 26 of the Y-shaped channel 22 will pass through the intermediate layer 30 through via 35 and into the first cross channel 34. The fluid passing through the first cross channel 34 passes into the upstream end of the base leg 44 in the second layer 40 at the downstream end of the first cross channel 34.

The intermediate layer 30 may also preferably be aligned such that the vias 37 at the upstream ends of the second cross channels 36 are aligned with the downstream ends of the second arms 28 of the Y-shaped channels 22. The second cross channels 36 traverse the width of the intermediate layer 30 such that the downstream ends of the second cross channels 36 are aligned with the upstream ends of the base leg 24 of the successive Y-shaped channel 22. As a result, fluids passing through the second cross channels 36 move from the second arms 28 of the Y-shaped channels 22 to the upstream end of the base legs 24 of the successive Y-shaped channels 22 (i.e., the Y-shaped channel located downstream).

Furthermore, the vias 37 located at the upstream ends of the second cross channels are open such that fluids passing in the downstream direction through the first arms 46 of the Y-shaped channels 42 in the second layer 40 also pass into the upstream end of the second cross channel 36. Those fluids also, then, pass through the second cross channel 36 where they are also delivered to the upstream end of the base legs 24 of the successive Y-shaped channels 22 in the first layer 20.

In the depicted embodiment of a static mixer that includes inlets 12 & 14 and outlets 17 & 18, the intermediate layer 30 also includes a via 14 that corresponds to the inlet 14 such that fluid introduced into the inlet 14 passes through the first layer 20 and also passes through the intermediate layer 30 before reaching the base leg 44 of the first Y-shaped channel 42 in the second layer 40. The X-shaped channel structure 32 located furthest downstream in the layer 30 also includes vias that correspond to the outlets 17 & 18 such that the fluid passing through the static mixer can exit the body 10.

Figure 5:
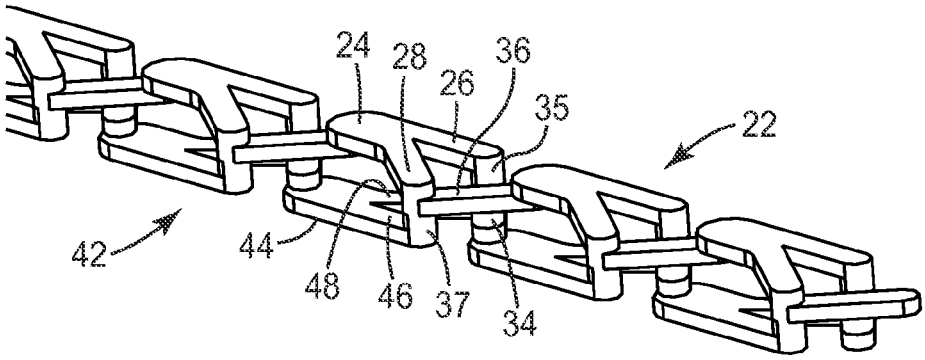
FIG. 5 is a reverse volume model depicting the flow channels in the exemplary static mixer depicted in FIGS. 1-4.

FIG. 5 is a reverse volume model view that depicts the flow through a middle section of a mixer constructed of the layers in FIGS. 2-4. The flow (which progresses in the downstream direction indicated by flow arrow 19) will be described using the reference numbers used in connection with the layers depicted in FIGS. 2-4.

Referring to FIG. 5, the flow through upper base leg 24 of the upper Y-shaped channel 22 splits into the first arm 26 and the second arm 28. At the downstream end of the first arm 26, the flow passes through a via 35 and into the first cross channel 34. At the downstream end of the second arm 28, the flow passes into the second cross channel 36.

Similarly, the flow through the lower base leg 44 of the lower Y-shaped channel 42 splits into first arm 46 and second arm 48. At the downstream end of the first arm 46, the flow passes through the via 37 and into the second cross channel 36 (where it joins the flow from the second arm 26 of the upper Y-shaped channel 22). At the downstream end of the second arm 48, the flow passes into the first cross channel 34 (where it joins the flow from the first arm 26 of the upper Y-shaped channel 22).

The flow through the first cross channel 34 passes into the upstream end of the base leg 44 of the successive lower Y-shaped channel 42. The flow through the second cross channel 36 passes into the upstream end of the base leg 24 of the successive upper Y-shaped channel 22. The flow process described above is then repeated through the upper and lower Y-shaped channels 22 & 42.

As a result, the fluid flowing through the first arms 46 of the lower Y-shaped channels 42 to the base legs 24 of the upper Y-shaped channels 22 passes through the second cross channels 36 in the intermediate layer 30. The fluid flowing through the second arms 48 of the lower Y-shaped channels 42 to the base legs 44 of the successive lower Y-shaped channels 42 passes through the first cross channels 34 in the intermediate layer 30.

FIG. 5 also depicts that, in the exemplary embodiment, the upper Y-shaped channels 22 and the lower Y-shaped channels 42 are located opposite from each other in the z-direction (i.e., perpendicular to the downstream direction), and that the first arms 26 of the upper Y-shaped channels 22 are in fluid communication with the second arms 48 of the lower Y-shaped channels 42 through z-direction vias extending between the first layer 20 and the second layer 40 (which in the depicted embodiment includes the optional cross channels 34 & 36 formed in the optional intermediate layer 30).

The dimensions of the static mixers of the present invention may be selected to obtain the desired flow rates and volumes suitable for the materials to be mixed. In the exemplary embodiment manufactured of three discrete layers (as depicted in FIGS. 1-4, the mixer body 10 may have dimensions of about 6 millimeters (mm) in length (measured in the flow direction), 0.5 mm in width, and 0.075 mm in height (with each layer having a thickness of 0.025 mm).

Within the mixer, the channel dimensions of the Y-shaped channels may be 0.325 mm in length (measured from the upstream end of the base leg to the downstream end of the first arm). The cross-channel width of the base legs may be 1 mm, with the arms having a width of 0.5 mm. The angle formed between the first and second arms may be 35 degrees. The channels may be formed with a depth of 0.1 mm into the respective layers. Although the channels in the different layers may be formed with similar dimensions, this may or may not be required (i.e., the dimensions may differ).

The static mixers of the present invention may be manufactured by any suitable technique, although it may be preferred that they be manufactured using layers that are formed separately and then attached to each other to form the appropriate channels. The layers may be attached to each other by any suitable technique that is capable sealing the different channels formed in the layers, such that the fluids passing through the channels does not leak into the interfaces between the layers.

Static mixing structure substrates may be bonded in individual fixed n-count element stacks, sequential chains of n-count element stacks, or in multiple parallel chains of n-count element stacks via any one or more of the following processes: thermal bonding, ultrasonic bonding, adhesive bonding (e.g., adhesive layer roll coated mixing structure substrate, adhesive sheet transfer from a backing roll (which may include a post operation for opening any obstructed holes)). Additionally, the mixing structure substrates may be assembled with precision registration of discrete chains or potentially have variants of multiple parallel and/or sequential substrate mixing patterns that function at a reduced, but acceptable, mixing efficiency via some semi-random registration scheme of the structure inputs, outputs, and individual mixing elements. This could include sizing the structure dimensions to provide similar mixing performance and pressure drop regardless of mixing feature alignment, particularly in the case of wider multiple parallel replicate mixing structure arrays.

Although described in terms of X- and Y-shaped channels, one skilled in the art can readily configure the above channels in alternate geometries, such as a W-shaped channel. Similarly, the channels can be layered to form alternate geometries, such as layering for example, Y-shaped layers to form a W-shaped channel.

The components of the mixers may be manufactured using any suitable technique, e.g., SMS-based vacuum/thermoformed female tooling, extrusion replication male tool embossing, chemical etching/lithography, two-photon polymerization, etc., and any combination of two or more thereof.

Suitable material or materials include, e.g., polymers (polycarbonates, polypropylenes, polyethylenes, etc.), glasses, metals, ceramics, silicons, etc. The selection of materials may be made based on a variety of factors including, but not limited to, manufacturability, compatibility with the materials to be mixed, thermal properties, optical properties, etc.

Figure 6:
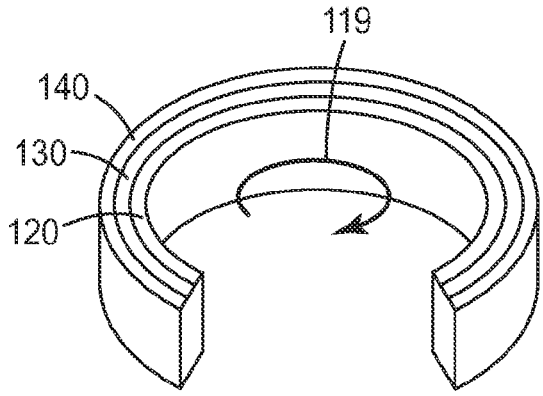
FIG. 6 is a perspective view of a curved body containing a static mixer according to the present invention.

Although the body 10 depicted in FIG. 1 is generally flat and the downstream direction of flow defined by the mixing structure may be described as following a straight linear path. The mixing structures of the invention may alternatively be located within a curved body as depicted in, e.g., FIG. 6. If the body containing the mixing structure is curved, the downstream direction of flow defined by the mixing structure may be described as following a curvilinear path through the body.

The bodies containing static mixers of the present invention may be rigid or flexible (where a flexible body may be manipulated between flat or non-flat (i.e., curved) without significant permanent deformation of the body and without destroying the integrity of the channels in the mixing structure). For example, in some embodiments, a body containing one or more of the static mixers of the present invention may be manipulated into a curved shape during use to assist in processing, reduce the volume needed for the mixer, etc.

Although the static mixers may be used in many different fluid applications, it may be preferred that the static mixers of the present invention be used in fluid systems that incorporate one or more of the static mixers.

Figure 7:
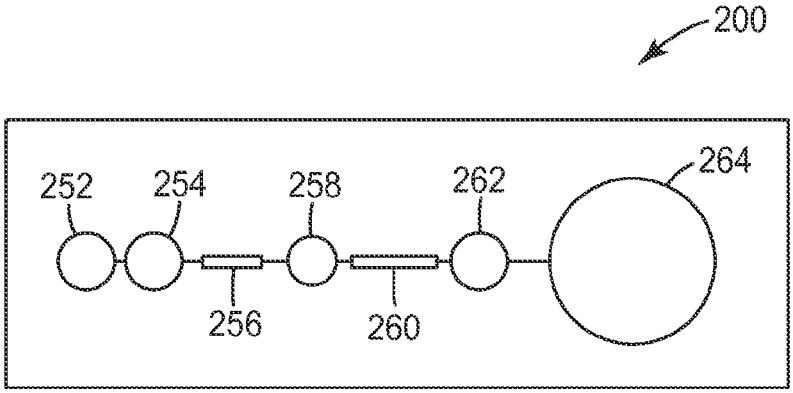
FIG. 7 is a perspective view of a device including two static mixers according to the present invention.

FIG. 7 depicts one exemplary fluid system 200 that is integrated into a body 202 and that incorporates multiple static mixers, at least one of which is a static mixer of the present invention and channels that can be used to fluidly connect the different features in the system 200. The depicted fluid system 200 includes two chambers 252 & 254 that feed into one mixer 256 provided in the fluid system 200. The mixer 256 may preferably, but not necessarily, be a static mixer constructed according to the present invention. Although two chambers 252 & 254 are included in the fluid system 200, other fluid systems 200 may include only one such chamber or more than two chambers that feed into the mixer 256. In the depicted embodiment, the chambers may be used to introduce one or more samples and one or more reagents into the mixer 256. In some embodiments, one of the chambers may be dedicated to introducing samples to the mixer 256 while the other chamber may be used to introduce one or more reagents into the mixer (although in some fluid systems, samples may be premixed or loaded with one or more reagents, carrier fluids, etc. into one or both of the chambers).

After passing through the first mixer 256, the mixed fluid may be collected in an intermediate chamber 258 located downstream of the mixer 256. The intermediate chamber 258 may, in some embodiments, contain one or more reagents that may be contacted by the mixed fluid entering the intermediate chamber 258. That contact may preferably result in at least some of the one or more reagents in the intermediate chamber 258 being taken up into the mixed fluid.

The fluid system 200 of FIG. 7 also includes a second mixer 260 located downstream of the intermediate chamber 258. The second mixer 260 may, for example, be used to mix one or more reagents taken up in the intermediate chamber 258 with the mixed fluid that was delivered into the intermediate chamber 258 from the first mixer 256. The second mixer 260 may be of the same design as the first mixer 256 or it may be of a different design. In some fluid systems, both mixers 256 and 260 may be constructed according to the present invention, while in other fluid systems only one of the mixers may be manufactured according to the principles of the present invention.

The fluids that exit the second mixer 260 may be delivered into another chamber 262 located downstream from the second mixer 260 in the fluid system 200. It may be preferred that the chamber 262 contain one or more additional reagents that may be combined with the mixed fluid exiting the second mixer 260. In some embodiments, for example, the chamber 262 may include one or more reagents that assist in detection of one or more analytes within the mixed fluid delivered into the chamber 262.

The fluid system 200 depicted in FIG. 7 may also preferably include a collection chamber 264 located downstream of the chamber 262. The collection chamber 264 may be used as, e.g., a waste chamber to collect materials from the chamber 262.

Fluid movement through the various features in the fluid system 200 may be supplied using any suitable technique or techniques through one or more channels extending between the different features in the system 200. For example, fluid movement may be driven by gravity, capillary forces, centrifugal forces (if, e.g., the fluid system 200 is rotated), etc. In some instances, the fluid system 200 may include one or more pumps that may function to either drive fluid through the various features using positive pressure or, alternatively, to pull fluids through the structures using negative pressure (e.g., vacuum) developed downstream of the fluid.

Although not depicted in FIG. 7, the fluid system 200 may also include one or more fluid control features such as valves to control the flow through the various features. For example, it may be preferred that any fluids introduced into the chambers 252 and 254 upstream of the first static mixer 256 be held in the chambers until the fluids are ready to be simultaneously introduced into the mixer 256. The valves may include physical structures (e.g., sacrificial membranes, ball valves, gate valves, etc.) that are physically opened or they may be fluidic features capable of providing fluid flow control (e.g., capillary valves that prevent fluid flow using, e.g., surface tension, etc.).

Applications of Static Mixers

In one application, the mixer can be used as a component of a device that can perform an immunoassay, such as a lateral flow immunoassay. One or more mixers can be embedded in a substrate that also includes reagents for an assay.

In one embodiment, the device could have a chamber upstream of the mixer to hold a binding agent, such as a conjugate antibody, and a feature downstream of the mixer, which provides a defined location where a capture agent, such as a capture antibody, can be immobilized.

Alternatively, the device could be designed with features that allow inserts upstream and/or downstream of the mixer. The inserts would consist of a substrate functionalized with a binding agent, such as conjugate and/or a capture antibody. Appropriate substrates used as inserts could include filter membranes such as nylon, nitrocellulose, PTFE, PVDF, polysulphone; or films such as polypropylene, polyester, polyethylene, and polycarbonate. Binding agents, such as capture and/or conjugate antibodies, may be immobilized on these membranes or film inserts using coating processes typically used for nitrocellulose-based immunoassays, such as those processes described by BioDot, Inc (Irvine, Calif.).

The device can also include features to allow for collection and containment of waste fluid downstream of the capture zone. For example, a reservoir filled with a cellulose wicking material in capillary contact with the microfluidic system capable of holding a volume of fluid between 10 and 1000 uL could be used. The wicking material can be chosen to have specific physical properties (i.e. porosity) that will allow not only containment of the waste fluid, but control of the capillary flow rates in the microfluidic device.

The device described above would be used in a manner similar to a lateral flow immunoassay. A given analyte can be introduced in the inlet port of the device upstream of the chamber containing the binding agent, such as conjugate antibody. The analyte-containing fluid then passes through or over the binding agent (e.g., conjugate antibody), allowing the binding agent to diffuse into the fluid stream. The fluid stream can pass through the static mixer as described herein which will facilitate for conjugation of the binding agent to the target analyte. Once mixed, the fluid containing the binding agent/target analyte complex can pass through or over the capture zone where the binding agent/target analyte complex will be captured by another binding agent, e.g., the immobilized capture antibody, thus forming the final immunoassay sandwich. Finally, the remaining fluid stream can enter and collect in the waste chamber. An optional readout determining the presence or absence of a complete immunoassay-sandwich could be based on visual or instrument-based detection, depending on the choice of labels used for the binding agents.

In a second embodiment, the device described above could incorporate parallel fluidic paths in a substrate to allow for the simultaneous detection of multiple analyte targets or to allow the inclusion of control tests. Each fluidic path could contain one or more of the static mixers described herein. The fluidic paths could feed from a single inlet or multiple inlets, depending on the requirements of the immunoassay of interest.

In another embodiment, the device could also include features upstream of the chamber for the binding agent, for example a conjugate antibody, to allow for incorporation of a sample preparation. For example, a chamber holding a lysing agent or other chemical treatments, could be incorporated upstream of the binding agent in order to liberate analytes, such as protein targets from a cell, that would otherwise not be accessible to the binding agent.

In some cases, it may be advantageous to include one or more mixer elements between a sample preparation chamber and the binding agent's location to increase the efficiency of the sample treatment (e.g., lysis efficiency). In other cases, the sample preparation may use paramagnetic beads to isolate and concentrate a sample. It may be possible to include features in the device that will hold these types of beads as well as the magnets necessary to effect the separations when necessary along the flow path. Another possibility may be to include features that will incorporate filtration elements based on size exclusion to prepare the sample.

The complete disclosure of the patents, patent documents, and publications cited in the Background, the Detailed Description of Exemplary Embodiments, and elsewhere herein are incorporated by reference in their entirety as if each were individually incorporated.

Exemplary embodiments of this invention are discussed and reference has been made to possible variations within the scope of this invention. These and other variations and modifications in the invention will be apparent to those skilled in the art without departing from the scope of the invention, and it should be understood that this invention is not limited to the exemplary embodiments set forth herein. Accordingly, the invention is to be limited only by the claims provided below and equivalents thereof.

The invention claimed is:

1. A static mixer comprising a mixing structure formed within a body, wherein fluid flowing through the mixing structure defines a downstream direction through the mixing structure, and wherein the mixing structure further comprises:

a first layer comprising a set of discrete first Y-shaped channels spaced apart along the downstream direction, wherein each first Y-shaped channel comprises a base leg extending in the downstream direction to a branch point at which the main channel separates into a first arm and a second arm; and a second layer comprising a set of discrete second Y-shaped channels spaced apart along the downstream direction, wherein each second Y-shaped channel comprises a base leg extending in the downstream direction to a branch point at which the main channel separates into a first arm and a second arm;

wherein fluid flowing in the downstream direction through the first arms of the first Y-shaped channels in the first layer passes to the base legs of the second Y-shaped channels in the second layer, and wherein fluid flowing in the downstream direction through the second arms of the first Y-shaped channels passes to the base legs of successive first Y-shaped channels in the first layer;

and wherein fluid flowing in the downstream direction through the first arms of the second Y-shaped channels in the second layer passes to the base legs of the first Y-shaped channels in the first layer, and wherein fluid flowing in the downstream direction through the second arms of the second Y-shaped channels passes to the base legs of successive second Y-shaped channels in the second layer.

2. A static mixer according to claim 1, wherein, for each of the first Y-shaped channels, the base leg and the first arm are aligned with the downstream direction and the second arm extends away to one side of the downstream direction.

3. A static mixer according to claim 1, wherein, for each of the second Y-shaped channels, the base leg and the first arm are aligned with the downstream direction and the second arm extends away to one side of the downstream direction.

4. A static mixer according to claim 1, the static mixer further comprising an intermediate layer located between the first layer and the second layer, wherein the fluid flowing through the first arms of the first Y-shaped channels to the base legs of the second Y-shaped channels passes through first cross channels located in the intermediate layer; and wherein the fluid flowing through the second arms of the first Y-shaped channels to the base legs of the successive first Y-shaped channels passes through second cross channels located in the intermediate layer.

5. A static mixer according to claim 4, wherein the first cross channel and the second cross channels form a series of successive X-shaped channel structures spaced apart from each other along the downstream direction.

6. A static mixer according to claim 4, wherein the fluid flowing through the first arms of the second Y-shaped channels to the base legs of the first Y-shaped channels passes through the second cross channels in the intermediate layer, and wherein the fluid flowing through the second arms of the second Y-shaped channels to the base legs of the successive second Y-shaped channels passes through the first cross channels in the intermediate layer.

7. A static mixer according to claim 6, wherein the first cross channel and the second cross channels form a series of successive X-shaped channel structures spaced apart from each other along the downstream direction.

8. A static mixer according to claim 1, wherein the first Y-shaped channels and the second Y-shaped channels are located opposite from each other in a Z-direction that is perpendicular to the downstream direction, and further wherein the first arms of the first Y-shaped channels are in fluid communication with the second arms of the second Y-shaped channels through Z-direction vias extending between the first layer and the second layer.

9. A static mixer according to claim 1, wherein the first Y-shaped channels and the second Y-shaped channels are located opposite from each other in a Z-direction that is perpendicular to the downstream direction, and further wherein the second arms of the first Y-shaped channels are in fluid communication with the first arms of the second Y-shaped channels through Z-direction vias extending between the first layer and the second layer.

10. A static mixer according to claim 1, wherein the first Y-shaped channels and the second Y-shaped channels are located opposite from each other in a Z-direction that is perpendicular to the downstream direction;

and wherein the first arms of the first Y-shaped channels are in fluid communication with the second arms of the second Y-shaped channels through Z-direction vias extending between the first layer and the second layer;

and further wherein the second arms of the first Y-shaped channels are in fluid communication with the first arms of the second Y-shaped channels through Z-direction vias extending between the first layer and the second layer.

11. A static mixer according to claim 1, wherein the body comprises a flexible body.

12. A static mixer according to claim 1, wherein the downstream direction comprises a straight linear path.

13. A static mixer according to claim 1, wherein the downstream direction comprises a curvilinear path.

14. An integrated fluid system comprising:

a static mixer according to claim 1;

a first chamber located upstream of the static mixer;

a second chamber located downstream of the static mixer; and fluid connection channels extending between the static mixer, the first chamber, and the second chamber.

15. A fluid system according to claim 14, wherein, for each of the first Y-shaped channels in the static mixer, the base leg and the first arm are aligned with the downstream direction and the second arm extends away to one side of the downstream direction.

16. A fluid system according to claim 14, wherein, for each of the second Y-shaped channels in the static mixer, the base leg and the first arm are aligned with the downstream direction and the second arm extends away to one side of the downstream direction.

17. A fluid system according to claim 14, wherein the static mixer further comprises an intermediate layer located between the first layer and the second layer, wherein the fluid flowing through the first arms of the first Y-shaped channels to the base legs of the second Y-shaped channels passes through first cross channels located in the intermediate layer; and wherein the fluid flowing through the second arms of the first Y-shaped channels to the base legs of the successive first Y-shaped channels passes through second cross channels located in the intermediate layer.

18. A fluid system according to claim 17, wherein the first cross channel and the second cross channels of the static mixer form a series of successive X-shaped channel structures spaced apart from each other along the downstream direction.

19. A fluid system according to claim 17, wherein the fluid flowing through the first arms of the second Y-shaped channels to the base legs of the first Y-shaped channels passes through the second cross channels in the intermediate layer, and wherein the fluid flowing through the second arms of the second Y-shaped channels to the base legs of the successive second Y-shaped channels passes through the first cross channels in the intermediate layer.

20. A fluid system according to claim 19, wherein the first cross channel and the second cross channels form a series of successive X-shaped channel structures spaced apart from each other along the downstream direction.

21. An immunoassay device, comprising the static mixer of claim 1.

22. A static mixer comprising a mixing structure formed within a body, wherein fluid flowing through the mixing structure defines a downstream direction through the mixing structure, and wherein the mixing structure further comprises:

a first layer comprising a set of discrete first Y-shaped channels spaced apart along the downstream direction, wherein each first Y-shaped channel comprises a base leg extending in the downstream direction to a branch point at which the main channel separates into a first arm and a second arm; and a second layer comprising a set of discrete second Y-shaped channels spaced apart along the downstream direction, wherein each second Y-shaped channel comprises a base leg extending in the downstream direction to a branch point at which the main channel separates into a first arm and a second arm;

an intermediate layer located between the first layer and the second layer, wherein the fluid flowing through the first arms of the first Y-shaped channels to the base legs of the second Y-shaped channels passes through first cross channels located in the intermediate layer; and wherein the fluid flowing through the second arms of the first Y-shaped channels to the base legs of the successive first Y-shaped channels passes through second cross channels located in the intermediate layer;

and wherein fluid flowing in the downstream direction through the first arms of the first Y-shaped channels in the first layer passes to the base legs of the second Y-shaped channels in the second layer, and wherein fluid flowing in the downstream direction through the second arms of the first Y-shaped channels passes to the base legs of successive first Y-shaped channels in the first layer;

and wherein fluid flowing in the downstream direction through the first arms of the second Y-shaped channels in the second layer passes to the base legs of the first Y-shaped channels in the first layer, and wherein fluid flowing in the downstream direction through the second arms of the second Y-shaped channels passes to the base legs of successive second Y-shaped channels in the second layer;

and wherein the first Y-shaped channels and the second Y-shaped channels are located opposite from each other in a Z-direction that is perpendicular to the downstream direction, and further wherein the second arms of the first Y-shaped channels are in fluid communication with the first arms of the second Y-shaped channels through Z-direction vias extending through the intermediate layer and between the first layer and the second layer.

* * * * *